United States Patent [19]

Tippetts et al.

[11] 4,256,015

[45] Mar. 17, 1981

[54] FLUIDIC STABILIZATION CONTROL

[75] Inventors: Thomas B. Tippetts, Mesa, Ariz.; Francis M. Manion, Rockville, Md.

[73] Assignees: The Garrett Corporation, Los Angeles, Calif.; United States of America, Washington, D.C.

[21] Appl. No.: 967,812

[22] Filed: Dec. 8, 1978

[51] Int. Cl.[3] ..... F15B 13/16

[52] U.S. Cl. ..... 91/364; 91/388; 89/41 H; 89/41 LE

[58] Field of Search ..... 89/41 LE, 41 H; 91/388, 91/364

[56] References Cited

U.S. PATENT DOCUMENTS

| | | | |
|---|---|---|---|
| 2,938,435 | 5/1960 | Gille | 89/41 H |
| 3,009,447 | 11/1961 | Lloyd | 91/388 |
| 3,017,775 | 1/1962 | Entin . | |
| 3,351,829 | 11/1967 | Ovarnstrom | 89/41 LE |
| 3,494,257 | 2/1970 | Welk, Jr. et al. | 91/388 |
| 3,594,553 | 7/1971 | McElroy . | |
| 3,739,689 | 6/1973 | Craven | 91/388 |
| 3,744,309 | 7/1973 | Astengo . | |
| 3,974,699 | 8/1976 | Morris et al. . | |
| 4,012,713 | 3/1977 | Greene et al. . | |
| 4,038,876 | 8/1977 | Morris . | |
| 4,164,167 | 8/1979 | Imai et al. | 01/364 |

*Primary Examiner*—Paul E. Maslousky

*Attorney, Agent, or Firm*—James W. McFarland; Albert J. Miller

[57] ABSTRACT

A fluidic system for stabilizing movement of a body subject to oscillation at its natural frequency, such as a tank-mounted gun, with appropriate circuitry and controls for notch filtering control output signals at the natural frequency.

24 Claims, 2 Drawing Figures

FLUIDIC STABILIZATION CONTROL

The Government has rights in this invention pursuant to Contract No. DAAG39-77-C-0029 awarded by the United States Army.

BACKGROUND OF THE INVENTION

This invention relates to fluidic control systems and more particularly relates to an improved notch filter for attenuating a fluidic control signal at a particular frequency.

Tank-mounted guns preferably include a control stabilization system in order to maintain target alignment while the vehicle is maneuvering over uneven terrain. Typically, such a stabilization system produces a feedback signal indicative of a desired rate of movement of the gun about a preselected axis, such as its elevational axis, and this feedback signal is compared to a desired input signal indicative of the desired rate of rotation of the gun about its elevational axis. Such a system is exemplary of many wherein the structural resonance of the body being controlled i.e. the gun, may severely affect the stabilization control system. More particularly, when the gun is in structural resonance the feedback signal can become of large amplitude and at a phase angle compared to the input signal which may produce an output control signal which intensifies rather than stabilizes gun oscillation at resonance.

SUMMARY OF THE INVENTION

Accordingly, it is a major object of the present invention to provide in such a gun and such a control system for controlling rate of movement of a body in a preselected direction, an improved notch filter control system and method, fluidic in nature, capable of reducing the amplitude of the feedback signal when the body is moving as its natural bending frequency.

Another important object is to provide improved method and apparatus presenting a stabilization control system utilizing the notch filter as described in the preceding object.

Yet another important object of the present invention is to provide improved method and apparatus for adjusting the phase of a fluidic pressure differential signal without making the gain of the signal dependent upon its frequency.

In summary, the invention contemplates a stabilization system for controlling rate of movement of a body in a preselected direction by generating a fluidic signal indicative of a desired rate of movement of the body in that direction, sensing and generating a negative feedback error signal indicative of actual rate of movement of the body in the particular direction. These two signals are compared and the gun movement altered in response thereto in order to bring body movement to that determined by the requested input signal. Further, a fluidic pressure differential signal is also generated as a function of acceleration of the body in the selected direction. This is accomplished through a spring mass accelerometer having a mass therein with a natural frequency approximately equal to the natural frequency of the body so that a large amplitude signal is generated from this acceleration signal sensor only when the body is moving substantially at its natural frequency. Through an improved delay circuit, phase shift of the output signal from the acceleration sensor is accomplished in a manner such that the phase-adjusted signal can then be algebraically added to the output signal of the rate sensor. As a result, the negative feedback signal is attenuated greatly in amplitude when the body is moving at its natural frequency, but at other frequencies the feedback signal is indicative of rate of movement of the body.

These and other objects and advantages of the present invention are specifically set forth in or will become apparent from the following detailed description of a preferred embodiment of the invention when read in conjunction with the accompanying drawing.

DETAILED DESCRIPTION OF THE PREFERRED EMBODIMENT

Figure 1:
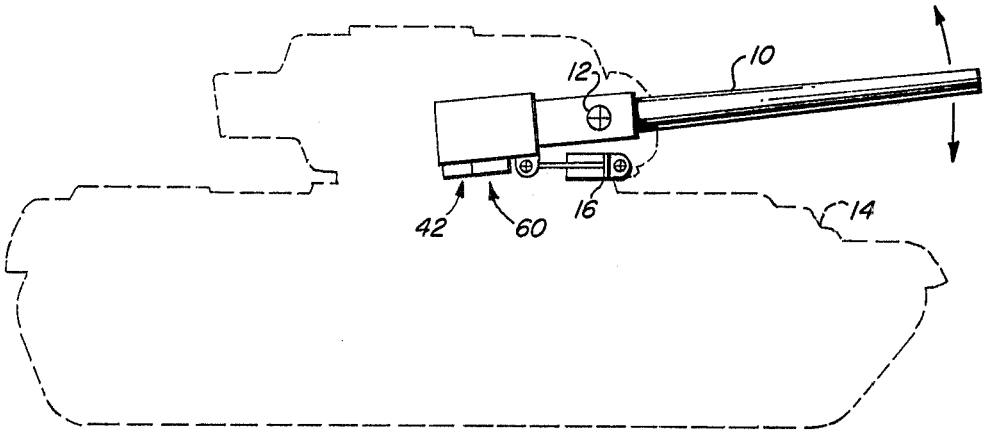
FIG. 1 is an elevational view of a gun having a control system as contemplated by the present invention, with the tank being shown in phantom.

Referring now more particularly to the drawing, a movable body in the form of an elongated barrel gun 10 having a natural bending frequency when rotating about its elevational axis 12 is mounted on a tank shown in phantom lines 14 in FIG. 1. Rotation of the gun about axis 12 is accomplished by a hydraulic actuator 16 and a hydraulic control valve 18 which selectively communicates pressurized fluid flow from a source 20 to actuator 16, as well as return flow therefrom to a low pressure liquid reservoir 22. Valve 18 is actuated to control gun movement by fluid pressure differential signals delivered thereto through lines 24 and 26.

Figure 2:
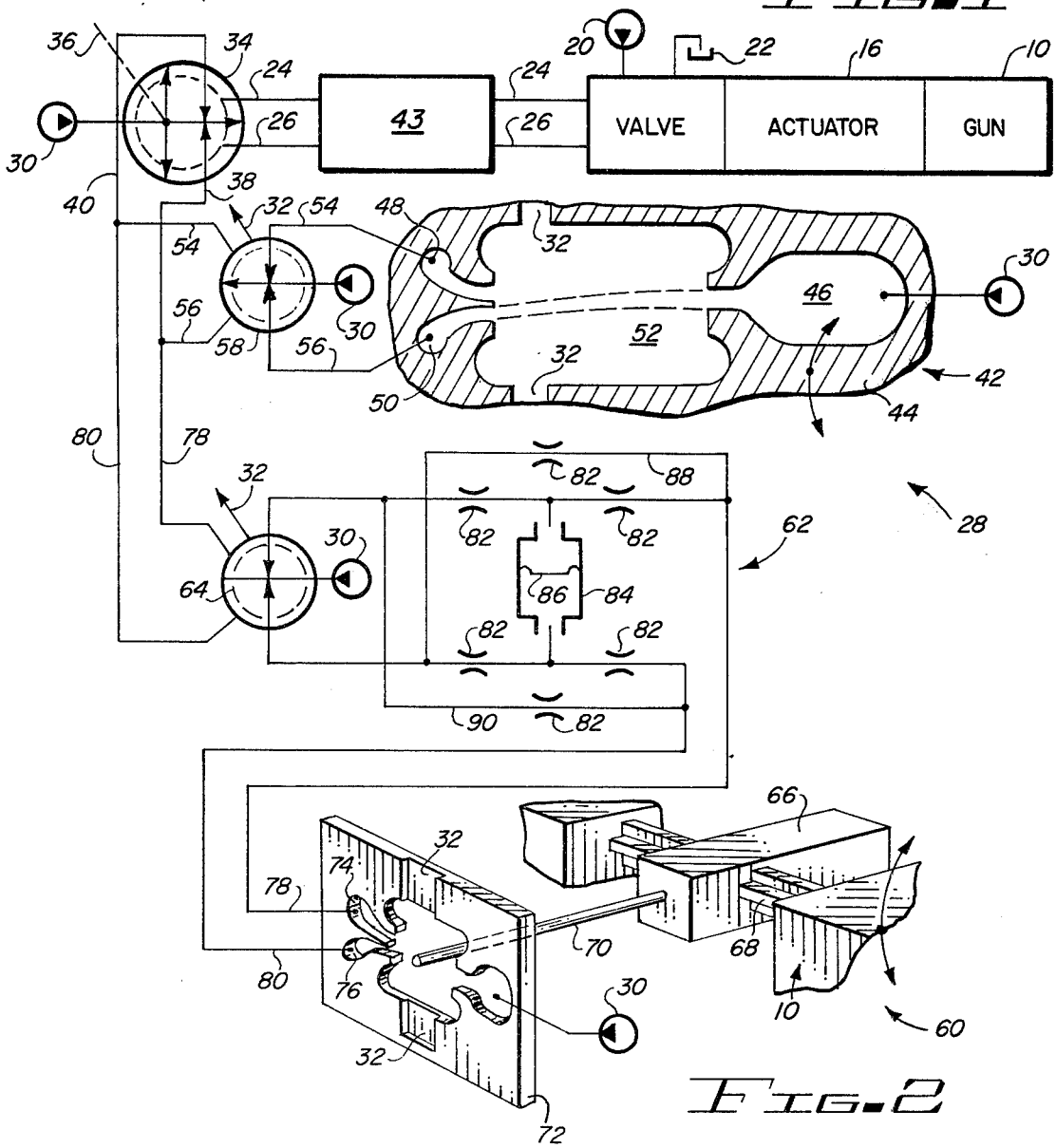
FIG. 2 is a partially schematic, partially diagrammatic illustration of an improved control system as contemplated by the present invention.

A fluidic stabilization system for controlling movement of gun 10 about axis 12 is generally denoted by the numeral 28 in FIG. 2. While applicable to pneumatic systems, the present invention is illustrated in a system 28 having a source of pressure regulated, hydraulic fluid flow shown at various locations within the system at numeral 30, as well as a common low pressure hydraulic fluid return reservoir receiving fluid from various of the fluidic devices from conduits 32 shown throughout the circuitry. System 28 includes a schematically depicted fluidic proportional amplifier 34 receiving a manual input signal, depicted by dashed line 36 in FIG. 2, to develop a fluid pressure differential signal indicative of the desired rate of movement of gun 10 about axis 12. Further, amplifier 34 acts as a comparator device, also receiving a fluid pressure differential signal from lines 38 and 40 which are compared to the fluid pressure differential signal created by input device 36. The resultant error output signal is then transmitted through conduits 24, 26 to operate valve 18 and bring gun rate of movement to that corresponding to the input signal. A dynamic compensation circuit 43 is included as necessary to provide the proper dynamic characteristics for control of gun 10.

The pressure differential signal transmitted by conduits 38, 40 constitutes a negative feedback signal indicative of actual rate of movement of gun 10 about axis 12. To this end circuitry 28 further includes a fluidic angular rate sensor 42 which includes a member 44 rigidly carried on gun 10 so as to rotate therewith in the direction illustrated by arrows on member 44. Member 44 incorporates passageways therein presenting a mechanical-to-fluidic transducer, and includes a chamber 46 receiving pressurized fluid flow from source 30 and issuing a jetstream therefrom toward a pair of output ports 48 and 50. The jet issuing from chamber 46 is spaced somewhat from the output ports, and must pass through an interaction region 52 therebetween communicating with low pressure return flow ducts 32. The inertia and associated effects upon the fluid stream issuing from chamber 46 in the interaction region causes the fluid stream, upon reaching the output ports, to be deflected proportionally to and in a direction related to the rate of rotation of member 44 and gun 10 about axis 12. As illustrated in FIG. 2, member 44 is rotating upwardly, causing a downward deflection of the fluid stream relative to member 44 as illustrated by dashed lines. As a result a pressure differential signal is generated across output ports 48 and 50 and to the communicating conduits 54 and 56 that is indicative of the direction and magnitude of the rate of rotation of gun 10 about axis 12. As appropriate, the fluid pressure differential output signal is amplified by one or a cascade of proportional fluidic amplifiers 58 and then delivered to conduits 38 and 40.

The fluidic circuit 28 further includes notch filter means for attenuating the fluid pressure differential output signal transmitted by conduits 38, 40 to comparator 34. The notch filter includes a spring-mass, fluidic angular accelerometer generally denoted by the numeral 60, a delay circuit 62 for adjusting the phase of the output signal of the notch filter, and as appropriate one or a cascade of proportional fluidic amplifiers 64. Accelerometer 60 includes a mass 66 preselected so as to have a natural frequency of oscillation substantially equal to the natural bending frequency of gun 10. Mass 66 is mounted through a flexural, torsional pivot 68 such as an X-shaped rod secured at both ends to rotate with gun 10. An output pin 70 mounted to mass 66 extends into the central interaction region of another mechanical-to-fluidic transducer 72 which provides a nozzle or stream of pressurized fluid from source 30 towards a pair of associated output ports 74 and 76 on the opposite side of the central interaction region. Pin 70 is operative to move in relation to acceleration of gun 10 about axis 12 and accordingly deflect the pressure stream toward one or the other of output ports 74, 76 so as to produce a pressure differential signal across these output ports and the associated conduit 78, 80, which is indicative of the magnitude and direction of angular acceleration of gun 10 about axis 12. Though not necessary for a complete understanding of the present invention, a more detailed description of the structure and operation of a mechanical-to-fluidic transducer of the type shown at element 72 may be found in U.S. Pat. No. 3,927,694. It is noted that the input member 36 may also be of this general type of transducer.

Delay circuit 62 operates to produce a time delay on the pressure differential signal across conduits 78, 80, and therefore acts as a circuit or means for adjusting or shifting the phase of that signal. Thus, while delay circuit 62 may be variously characterized as a phase shift, phase adjustment or time delay circuit, for purposes of clarity, it is referred to only as a delay circuit 62 in this detailed description of the preferred embodiment.

Delay circuit 62 includes a plurality of fixed flow resistors 82 each of which provide substantially equal resistance to fluid flow therethrough. A pair of resistors 82 are arranged in series in each of conduits 78, 80, and a capacity-type fluid accumulator 84 is interposed across conduit 78, 80. More particularly, the accumulator 84 includes an internal, pressure responsive bellows 86 dividing the interior of the accumulator into opposed chambers each of which communicates with the respective conduits 78, 80 at a location intermediate the two series arranged restrictors 82 associated with that conduit. Delay circuit 62 further includes a pair of feedforward circuits 88, 90 each of which communicates with the two conduits 78, 80 in crossing relationship, with conduit 88 extending from conduit 78 upstream of the pair of orifices 82 and communicating with conduit 80 downstream of its pair of orifices 82, and conduit 90 making a similar, converse cross-connection from conduit 80 to conduit 78. Also interposed in each of the feedforward conduits 88, 90 is another fixed flow restrictor 82. The fluid pressure differential signal across conduit 78, 80 is algebraically added to that across conduits 54, 56 from the angular rate sensor 42 so as to produce the desired negative feedback signal in conduits 38, 40.

In operation, a desired rate of movement of gun 10 about axis 12 is commanded by input signal 36. The actual rate of movement of gun 10 is sensed by angular rate sensor 42, and a corresponding fluidic pressure differential output signal is generated across lines 54, 56 which is then algebraically added to the command input signal by comparator 34 to produce the error output signal on conduits 24, 26. This error output signal operates valve 18 to port fluid flow to actuator 16 and adjust rate of movement of the gun 10 to that dictated by the command signal from input 36.

Through most of operation of the gun, the fluid pressure differential signal generated by spring mass accelerometer 60 and ultimately transmitted to conduit 78, 80 is of a magnitude significantly less than that produced by the angular rate sensor 42. Accordingly throughout most of operation of the gun the signal transmitted by conduits 38, 40 is substantially the same as that produced across conduits 54, 56.

However, once the gun 10 begins moving at its natural bending frequency about elevational axis 12, this excites the mass 66 of the spring mass accelerometer into resonance. As a result a substantially larger signal is generated by transducer 72 and transmitted to conduit 78 and 80. Delay circuit 62 then adjusts the phase of the fluid pressure signal in conduit 78 and 80 in relation to the phase of the signal in conduit 54 and 56. The phase adjusted signal is then amplified as necessary by amplifier 64 to have a magnitude approximately equal to that generated across conduits 54, 56. Due to the phase adjustment, the straightforward algebraic addition by interconnection of the pairs of conduits 78, 80 with conduits 54, 56 essentially cancel out one another resulting in a substantially zero pressure differential signal being delivered by conduits 38, 40 to comparator 34. Mass 66 and its flexural pivot 68 are so configured so as to produce a relatively under damped spring-mass system which provides high amplitude at the resonant frequency but low magnitude signals at other frequencies.

In this manner it can be seen that by adjusting the phase of the output signal across conduit 78, 80 (which produces an effective signal only at the natural frequency) that the signal produced by the angular rate sensor 42 can be directly utilized by comparator 34.

The phase adjustment produced by delay circuit 62 is preselected so as to assure cancellation of the acceleration and the rate signals at the resonant frequency. However, the delay circuit is also arranged so as not to produce frequency dependent gain change in output signal conduit 78 and 80. That is, the gain across conduit 78, 80 has a flat response to the frequency of the signal it is carrying. More particularly, the two pairs of serially arranged resistors 82 directly in each of conduits 78, 80, in conjunction with the capacitor 84, produces a lag, and somewhat reduces the magnitude of the input signal at the associated points in conduits 78, 80. As a result, the output of the action of the two pairs of serially arranged resistors and the capacitor 84 is to produce a transfer function according to the following formula: $(1/1+\tau S)$, where $\tau$ is the time constant of delay circuit 62, and S is the Laplace transform operator.

At the same time, the feedforward lines 88, 90 along with their single resistors 82 (which thus provide resistance approximately half that experienced by fluid flow directly in conduit 78, 80 due to the equal value of all of the resistors 82) returns to the conduits 78, 80 a proportional signal with a gain twice as high as that delivered directly through the pairs of serially arranged orifices. Due to the cross-over connection of the two feedforward ducts 88, 90, the combined transfer function of the entire delay circuit 62 then becomes the following: $2-[(1/1+\tau S)]$.

By straightforward algebraic rearrangement, the above equation becomes the following: $(1-\tau S)/(1+\tau S)$. This transfer function does not make the gain of the signal dependent upon the signal frequency. At the same time, a phase shift occurs dependent upon the magnitude of the time constant, $\tau$. By proper selection of the resistors 82 and the capacitor 84, the time constant $\tau$ is adjusted to the natural frequency required, with a desired phase shift then occurring at the natural frequency.

From the foregoing it will therefore be apparent that the present invention also contemplates an improved method of controlling movement of a body in a preselected direction when the body has a characteristic natural frequency of movement in that direction, the method including the steps of generating a first fluidic signal from sensor 42 indicative of the actual rate of movement of the body in the selected direction, generating another fluidic signal by input member 36 indicative of the desired rate of movement of the body; altering the rate of movement of the body in response to the error signal which is generated by comparison of the first and second fluidic signals; and sharply attenuating the feedback signal of actual rate of body movement at only the natural frequency of the body. Attenuation is accomplished by fluidically sensing acceleration of the body in that direction but producing a large magnitude acceleration signal only at the natural frequency by utilizing a spring mass system having its own natural frequency approximately equal to the natural frequency of the body. The phase of the acceleration signal is adjusted such that upon subsequently adding the phase adjusted acceleration signal to the angular rate sensor signal, the feedback signal is sharply attenuated only at the natural frequency.

The foregoing detailed description of the preferred embodiment of the invention should be considered exemplary in nature and not as limiting to the scope and spirit of the invention as set forth in the appended claims.

Having described the invention with sufficient clarity that those skilled in the art may make and use it, we claim:

1. In a fluidic control system generating a fluidic rate signal indicative of rate of movement of a body in a preselected direction, wherein said body has a characteristic natural bending frequency as said body moves in said direction; a fluidic notch filter for reducing said fluidic rate signal to a minimum value at said natural frequency, comprising:

sensor means operably coupled with said body for generating a fluidic acceleration signal indicative of acceleration of said body in said direction, said sensor means having a mass with a natural frequency approximately equal to said body natural frequency, the magnitude of said fluidic acceleration signal being approximately equal to the magnitude of said rate signal at said natural frequency but substantially less at other frequencies; and fluidic circuit means for combining said rate signal and acceleration signal to reduce said rate signal to said minimum value at said natural frequency.

2. In a fluidic control system for controlling movement of a body in a preselected direction, wherein said body has a characteristic natural bending frequency as said body moves in said direction:

means for providing an input signal indicative of a desired rate of movement of said body in said direction;

a first sensor operably coupled with said body for generating a first fluidic signal indicative of the actual rate of movement of the body in said direction;

a second sensor operably coupled with said body for generating a second fluidic signal indicative of acceleration of said body in said direction, said second sensor including a mass having a natural frequency approximately equal to said natural frequency of the body, the magnitude of said second fluidic signal being approximately equal to the magnitude of said first fluidic signal at said natural frequency, and being substantially less than that of said first fluidic signal at other frequencies;

fluidic circuit means for summing said first and second fluidic signals to produce a third fluidic signal having essentially zero magnitude at said natural frequency, and a magnitude proportional to said first fluidic signal at said other frequencies;

means for comparing said input signal and said third fluidic signal to generate a fluidic error signal; and actuator means responsive to said fluidic error signal and operably associated with said body for adjusting said rate of movement of the body in relation to said error signal.

3. A system as set forth in claims 1 or 2, wherein said fluidic circuit means includes a delay circuit for adjusting the phase of said fluidic acceleration signal.

4. A system as set forth in claim 3, wherein said delay circuit provides a phase shift in said fluidic acceleration signal of preselected value at said natural frequency without causing change in gain of said acceleration signal as a function of frequency.

5. A system as set forth in claim 4, wherein said delay circuit has a transfer function of $(1-\tau S)/(1+\tau S)$, where $\tau$ is the time constant of said delay circuit and S is the Laplace Transform operator.

6. A system as set forth in claim 5, wherein said fluidic acceleration signal comprises a fluid pressure differential signal carried in a pair of conduits, said delay circuit including first flow resistances in each of said conduits, capacitance means for reducing the magnitude of said pressure differential signal passing through said first flow resistances, and a pair of feed-forward conduits communicating in crossing relation with said pair of conduits upstream and downstream of said first flow resistances, said feed-forward conduits each having second flow resistances therein providing flow resistance of approximately half the magnitude of said first flow resistances.

7. A system as set forth in claim 6, wherein said first flow resistances each comprise a pair of serially arranged flow restrictors, said second flow resistances each comprising a single flow restrictor, all said restrictors presenting approximately equal resistance to fluid flow.

8. A system as set forth in claim 7, wherein said capacitance means comprises a fluid flow accumulator having a flexible diaphragm traversing the interior thereof to define opposed first and second fluid chambers, said first and second chambers communicating with said pair of conduits at a position intermediate the associated pair of serially arranged restrictors.

9. A system as set forth in claims 1 or 2, wherein said preselected direction is angular rotation of said body about a predetermined axis.

10. A system as set forth in claim 9, wherein said first sensor means comprises a fluidic angular rate sensor developing a fluid pressure differential output signal whose magnitude is indicative of the magnitude and direction of rate of rotation of said body about said axis.

11. A system as set forth in claim 10, wherein said second sensor means comprises a fluidic, relatively undamped, spring mass accelerometer developing a fluid pressure differential output signal having a relatively large magnitude substantially only at said natural frequency.

12. A system as set forth in claim 11, wherein said accelerometer comprises said mass, a flexural pivot securing said mass to said body for permitting movement of said mass about said pivot in response to angular acceleration of said body about said predetermined axis, and a mechanical-to-fluidic transducer for generating said second pressure differential output signal in response to movement of said mass.

13. A system as set forth in claim 12, wherein said fluidic circuit means includes a delay circuit for adjusting the phase of said fluidic acceleration signal.

14. A system as set forth in claim 13, wherein said delay circuit has a transfer function of $(1-\tau S)/(1+\tau S)$, where $\tau$ is the time constant of said delay circuit and S is the Laplace Transform operator.

15. A system as set forth in claim 14, wherein said fluidic acceleration signal comprises a fluid pressure differential signal carried in a pair of conduits, said delay circuit including first flow resistances in each of said conduits, capacitance means for reducing the magnitude of said pressure differential signal passing through said first flow resistances, and a pair of feed-forward conduits communicating in crossing relation with said pair of conduits upstream and downstream of said first flow resistances, said feed-forward conduits each having second flow resistances therein providing flow resistance of approximately half the magnitude of said first flow resistances.

16. A system as set forth in claim 13, wherein said first flow resistances each comprise a pair of serially arranged flow restrictors, said second resistances each comprising a single flow restrictor, all of said restrictors presenting approximately equal resistance to fluid flow.

17. A system as set forth in claim 16, wherein said capacitance means comprises a fluid flow accumulator having a flexible diaphragm traversing the interior thereof to define opposed first and second fluid chambers, said first and second chambers communicating with said pair of conduits at a position intermediate the associated pair of serially arranged restrictors.

18. A fluidic notch filter for filtering a fluidic output signal at the natural frequency of a body, comprising:

a first sensor operably coupled with said body for generating a first fluidic output signal indicative of the rate of movement of said body in a preselected direction;

a second sensor operably coupled with said body for generating a second fluidic output signal indicative of acceleration of said body in said preselected direction, said second sensor including means having a natural frequency approximately equal to the natural frequency of said body as said body moves in said direction; and fluidic circuit means for combining said first and second signals into a third output control signal having essentially zero magnitude upon movement of said body at said natural bending frequency in said direction, and having a magnitude correlated to the magnitude of said first output signal at other frequencies.

19. A notch filter as set forth in claim 18, wherein said fluidic circuit means includes a delay circuit for adjusting the phase of said fluidic acceleration signal.

20. A notch filter as set forth in claim 19, wherein said delay circuit provides a phase shift in said fluidic acceleration signal of preselected value at said natural frequency without causing change in gain of said acceleration signal as a function of frequency.

21. A notch filter as set forth in claim 20, wherein said delay circuit has a transfer function of $(1-\tau S)/(1+\tau S)$, where $\tau$ is the time constant of said delay circuit and S is the LaPlace Transform operator.

22. A notch filter as set forth in claim 21, wherein said fluidic acceleration signal comprises a fluid pressure differential signal carried in a pair of conduits, said delay circuit including first flow resistances in each of said conduits, capacitance means for reducing the magnitude of said pressure differential signal passing through said first flow resistances, and a pair of feed-forward conduits communicating in crossing relation with said pair of conduits upstream and downstream of said first flow resistances, said feed-forward conduits each having second flow resistances therein providing flow resistance of approximately half the magnitude of said first flow resistances.

23. A fluidic stabilization system for controlling rotation of a body about a preselected axis, wherein said body has a natural bending frequency about said axis, comprising:

a source of pressurized fluid;

a reservoir;

a fluid actuator operably coupled to rotate said body about said axis;

valve means for controlling fluid flow between said source, reservoir and actuator;

means for developing a first fluid pressure differential signal indicative of a desired rate of rotation of said body;

fluidic sensor means for developing a second fluid pressure differential signal indicative of actual rate of rotation of said body;

fluidic comparator means responsive to said first and second signals for generating a fluid pressure differential error signal for operating said valve means to substantially equalize said actual and desired rates of rotation; and fluidic notch filter means operably associated with said sensor means for attenuating said second signal substantially only at said natural frequency, said filter means including a relatively under damped, fluidic spring mass accelerometer generating a fourth pressure differential output signal of magnitude approximately equal to said second signal substantially only at said natural frequency, said accelerometer operably coupled to said body to generate said fourth signal in relation to angular acceleration of the body about said axis, said filter further including means for adjusting the phase of said fourth signal to substantially cancel said second signal at said natural frequency.

24. A method of controlling movement of a body in a preselected direction wherein said body has a characteristic natural frequency of oscillation as said body moves in said direction, comprising the steps of:

generating a first fluidic input signal indicative of a desired rate of movement of the body in said direction;

fluidically sensing rate of movement of the body in said direction and generating a second fluidic signal indicative thereof;

comparing the first and second signals to generate a fluidic error signal;

altering the rate of movement of the body in response to said fluidic error signal;

fluidically sensing acceleration of the body in said direction and generating a fourth signal indicative thereof, said fourth signal being of substantially smaller magnitude than said second signal at frequencies other than said natural frequency and having a magnitude approximately equal to said second signal at substantially said natural frequency;

adjusting the phase of said fourth signal; and subsequently summing said second and said phase adjusted fourth signal whereby said second signal is sharply attenuated in magnitude substantially only at said natural frequency.

* * * * *

UNITED STATES PATENT AND TRADEMARK OFFICE

CERTIFICATE OF CORRECTION

PATENT NO. : 4,256,015

DATED : March 17, 1981

INVENTOR(S) : Thomas B. Tippetts, Francis M. Manion

It is certified that error appears in the above-identified patent and that said Letters Patent are hereby corrected as shown below:

Col. 5, line 12, the formula should read: $\frac{1}{1 + \tau S}$ ;

line 24, the formula should read: $2 - \frac{1}{1 + \tau S}$ .

Signed and Sealed this

Second Day of June 1981

[SEAL]

Attest:

RENE D. TEGTMEYER

Attesting Officer

Acting Commissioner of Patents and Trademarks